US011841139B2

(12) United States Patent
Culler

(10) Patent No.: US 11,841,139 B2
(45) Date of Patent: Dec. 12, 2023

(54) RESONANCE PREVENTION USING COMBUSTOR DAMPING RATES

(71) Applicant: Honeywell International Inc., Morris Plains, NJ (US)

(72) Inventor: Wyatt Culler, Berne, IN (US)

(73) Assignee: Honeywell International Inc., Charlotte, NC (US)

( * ) Notice: Subject to any disclaimer, the term of this patent is extended or adjusted under 35 U.S.C. 154(b) by 165 days.

(21) Appl. No.: 16/798,318

(22) Filed: Feb. 22, 2020

(65) Prior Publication Data

US 2021/0262663 A1 Aug. 26, 2021

(51) Int. Cl.

| | |
|---|---|
| ***F23N 5/24*** | (2006.01) |
| ***F23N 5/16*** | (2006.01) |
| ***F23N 1/00*** | (2006.01) |
| ***F23N 5/26*** | (2006.01) |

(52) U.S. Cl.

CPC ..... *F23N 5/16* (2013.01); *F23N 1/002* (2013.01); *F23N 5/265* (2013.01); *F23N 2225/00* (2020.01); *F23N 2900/05005* (2013.01)

(58) Field of Classification Search

CPC ..... F23N 2225/00; F23N 2900/05005; F23N 1/002; F23N 5/265; F23N 5/16

USPC ..... 431/18, 75

See application file for complete search history.

(56) References Cited

U.S. PATENT DOCUMENTS

| | | | | |
|---|---|---|---|---|
| 4,557,106 | A | 12/1985 | Ffowes Williams et al. | |
| 5,120,214 | A | 6/1992 | West et al. | |
| 6,205,764 | B1 | 3/2001 | Hermann et al. | |
| 7,559,234 | B1 * | 7/2009 | Chorpening | G01M 15/102 700/274 |
| 9,234,661 | B2 | 1/2016 | Young et al. | |
| 10,072,843 | B2 | 9/2018 | Baramov et al. | |
| 2005/0144955 | A1 * | 7/2005 | Handelsman | F23N 5/16 60/772 |
| 2005/0247064 | A1 | 11/2005 | Lieuwen | |
| 2006/0224357 | A1 * | 10/2006 | Taware | G07C 5/085 702/179 |

(Continued)

FOREIGN PATENT DOCUMENTS

| | | | |
|---|---|---|---|
| JP | H07260139 | A | 10/1995 |
| WO | 9834067 | A1 | 8/1998 |

OTHER PUBLICATIONS

Extended European search report for corresponding EP Application No. 21157495.9.

(Continued)

*Primary Examiner* — Avinash A Savani

(74) *Attorney, Agent, or Firm* — Ortiz & Lopez, PLLC; Kermit D. Lopez; Luis M. Ortiz

(57) ABSTRACT

Methods and systems for resonance suppression, can involve measuring signals with one or more sensors, wherein the signals are produced by a combustor associated with an actuator, and receiving at a controller the signals measured by the sensor or sensors. The controller can calculate a damping rate of the combustor. Based on the damping rate, the controller can modulate the actuator if the damping rate falls below a predefined threshold and can continue to modulate the actuator until the damping rate is adjusted and the resonance is suppressed. The sensor can be an acoustic sensor, an optical sensor, or another type of sensor.

18 Claims, 6 Drawing Sheets

(56) References Cited

U.S. PATENT DOCUMENTS

| | | | | |
|---|---|---|---|---|
| 2006/0228658 | A1* | 10/2006 | Paschereit | F23M 20/005 431/75 |
| 2007/0119147 | A1* | 5/2007 | Cornwell | F01D 21/003 60/39.281 |
| 2007/0214796 | A1* | 9/2007 | Bland | F01D 21/003 60/804 |
| 2010/0077942 | A1* | 4/2010 | D'Agostini | F23C 6/04 110/205 |
| 2015/0224997 | A1* | 8/2015 | Glugla | B60W 50/06 701/33.1 |
| 2015/0377485 | A1 | 12/2015 | Cha et al. | |
| 2016/0273449 | A1* | 9/2016 | DiCintio | F23D 11/16 |
| 2017/0115004 | A1 | 4/2017 | Baramov et al. | |
| 2018/0128483 | A1 | 5/2018 | Bothein et al. | |
| 2018/0149363 | A1* | 5/2018 | Arthanari | F02C 9/34 |

OTHER PUBLICATIONS

Nicolas Noiray and Bruno Schuermans, "Deterministic quantities characterizing noise driven Hopf bifurcations in gas turbine combustors", International Journal of Non-Linear Mechanics, vol. 50, Apr. 2013, pp. 152-163.

"Cloud computing", Wikipedia, Retrieved from "https://en.wikipedia.org/w/index.php?title=Cloud_computing&oldid=937722739", page was last edited on Jan. 26, 2020, at 21:54 (UTC).

"Surface acoustic wave sensor", Wikipedia, Retrieved from "https://en.wikipedia.org/w/index.php?title=Surface_acoustic_wave_sensor&oldid=920926712", page was last edited on Oct. 12, 2019, at 19:21 (UTC).

* cited by examiner

RESONANCE PREVENTION USING COMBUSTOR DAMPING RATES

TECHNICAL FIELD

Embodiments are generally related to the field of industrial combustion systems. Embodiments also relate to resonance suppression in industrial combustion systems. Embodiments also relate to resonance prevention and/or suppression using combustor damping rates.

BACKGROUND

Combustion resonance is a phenomenon that can occur in many combustion devices, such as, industrial heaters, gas turbines, and jet and rocket engines. Combustion resonance is caused by the acoustics of a combustion chamber interacting with a flame in a feedback loop. For example, standing wave patterns in the combustion chamber can interact with the flame to cause high amplitude pressure oscillations.

Industrial combustion systems sometimes experience such "resonance" as an undesirable phenomenon where feedback between the flame and the combustion chamber acoustics create coherent oscillations. These coherent oscillations can increase emissions, and if left unchecked can cause combustion system damage through overheating or high-cycle fatigue failure. Resonance is a systems problem, and most often appears only once a combustion system is out in the field. Resonance can also occur in previously non-resonant systems due to changes in ambient conditions, fuel composition, or operating conditions. The sensitivity of resonance has many factors that make it difficult to predict and costly to solve out in the field.

BRIEF SUMMARY

The following summary is provided to facilitate an understanding of some of the features of the disclosed embodiments and is not intended to be a full description. A full appreciation of the various aspects of the embodiments disclosed herein can be gained by taking the specification, the claims, the drawings, and the abstract as a whole.

It is, therefore, one aspect of the disclosed embodiments to provide for an improved industrial combustion method and system.

It is another aspect of the disclosed embodiments to provide for a method and system, which allows for resonance suppression/prevention in industrial combustion systems.

It is yet another aspect of the disclosed embodiments for provide for a method and system of resonance prevention and/or suppression using combustor damping rates.

The aforementioned aspects and other objectives can now be achieved as described herein. In an embodiment, a method for resonance suppression, can involve: measuring signals with at least one sensor, wherein the signals are produced by a combustor associated with an actuator; and receiving at a controller the signals measured by at least one sensor, wherein the controller calculates a damping rate of the combustor, and wherein based on the damping rate, the controller modulates the actuator if the damping rate falls below a predefined threshold and continues to modulate the actuator until the damping rate is adjusted and the resonance is suppressed.

In an embodiment of the method, the at least one sensor can comprise an acoustic sensor (e.g., a microphone).

In an embodiment of the method, the at least one sensor can comprise an optical sensor.

In an embodiment of the method, the combustor can comprise a burner.

In an embodiment of the method, the damping rate can comprise a real-time damping rate.

In an embodiment of the method, the damping rate can comprise a control signal for active instability suppression of the resonance by modulating a fuel supply as a result of modulating the actuator.

In an embodiment of the method, the at least one sensor can be mounted on a combustion chamber associated with the combustor.

In another embodiment, a system for resonance suppression, can include: at least one sensor operable to measure acoustic signals produced by a combustor associated with an actuator; and a controller that receives the signals measured by at least one sensor, calculates a damping rate of the combustor, and based on the damping rate modulates the actuator if the damping rate falls below a predefined threshold. The controller continues to modulate the actuator until the damping rate is adjusted and the resonance is suppressed.

In another embodiment, a system for resonance suppression, can include at least one processor; and a non-transitory computer-usable medium embodying computer program code, the computer-usable medium capable of communicating with at least one processor, the computer program code comprising instructions executable by the at least one processor and configured for: measuring signals with at least one sensor, wherein the signals are produced by a combustor associated with an actuator; and receiving at a controller the signals measured by at least one sensor, wherein the controller calculates a damping rate of the combustor, and wherein based on the damping rate, the controller modulates the actuator if the damping rate falls below a predefined threshold, and continues to modulate the actuator until the damping rate is adjusted and the resonance is suppressed.

BRIEF DESCRIPTION OF THE DRAWINGS

The accompanying figures, in which like reference numerals refer to identical or functionally-similar elements throughout the separate views, and which are incorporated in and form a part of the specification, further illustrate the present invention and, together with the detailed description of the invention, serve to explain the principles of the disclosed embodiments.

DETAILED DESCRIPTION

The particular values and configurations discussed in these non-limiting examples can be varied and are cited merely to illustrate one or more embodiments and are not intended to limit the scope thereof.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other issues, subject matter may be embodied as methods, devices, components, or systems. Accordingly, embodiments may, for example, take the form of hardware, software, firmware, or a combination thereof. The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein may not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Generally, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Figure 1A:
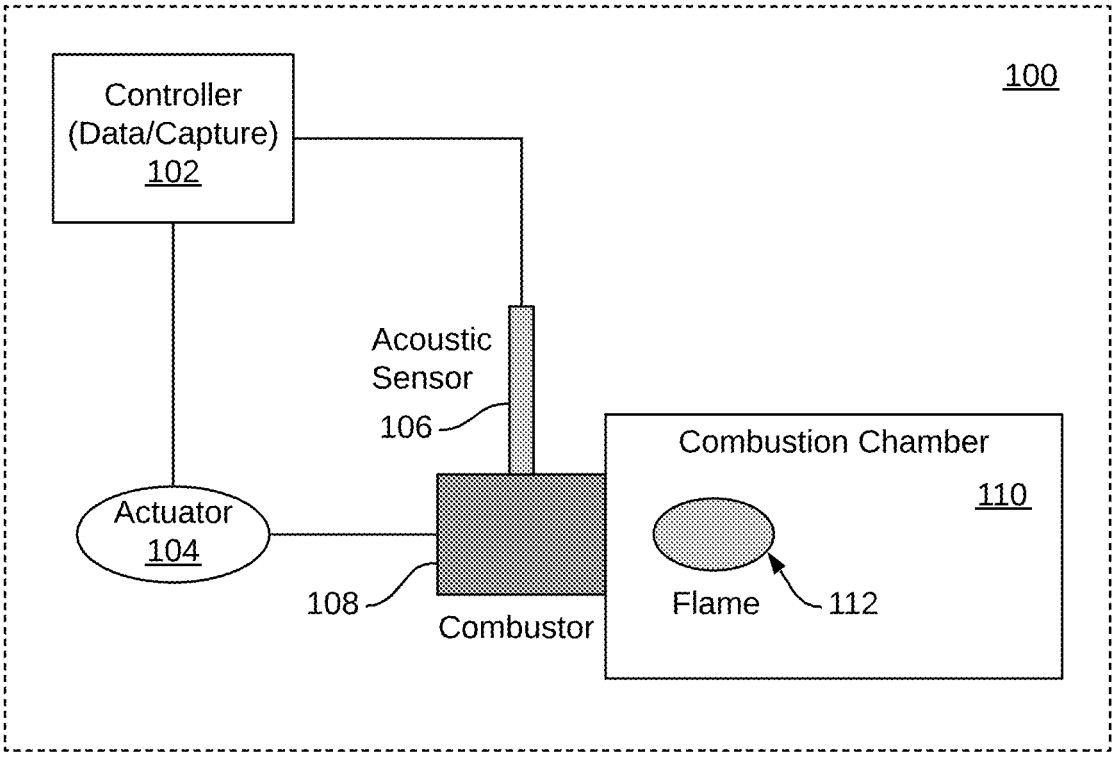
FIG. 1A illustrates a system for resonance suppression that can include the use of an acoustic sensor, in accordance with an embodiment.
Figure 1B:
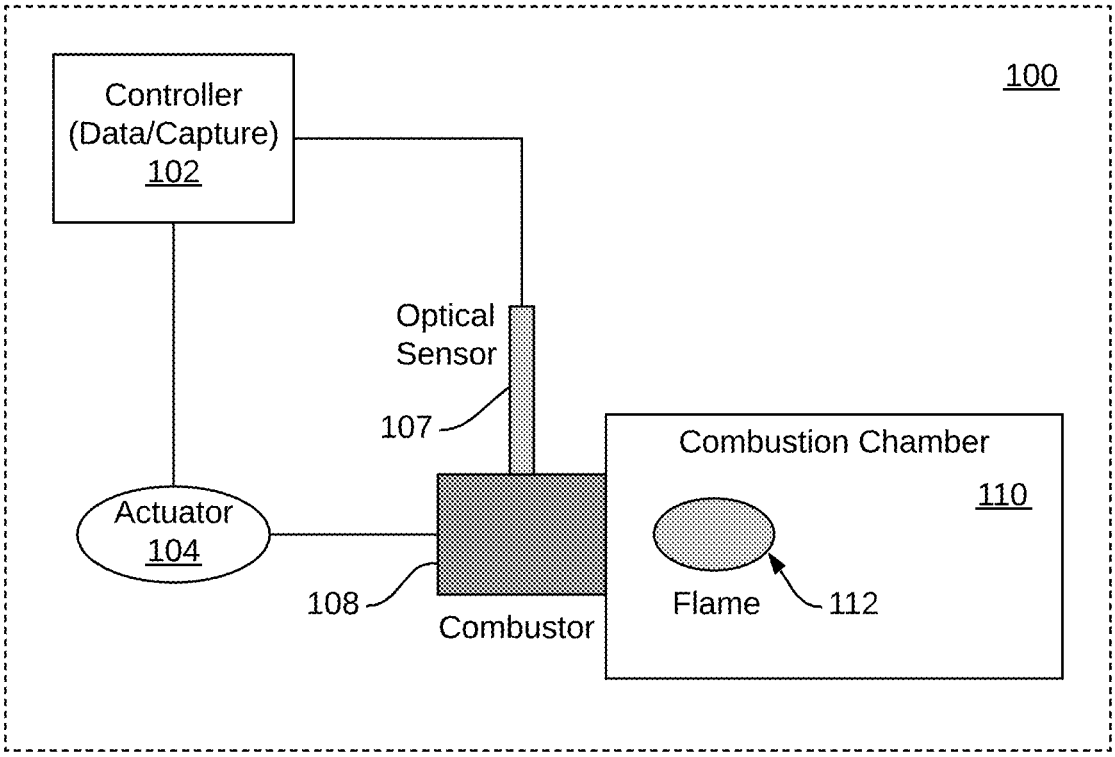
FIG. 1B illustrates a system for resonance suppression that can include the use of an optical sensor, in accordance with an alternative embodiment.
Figure 1C:
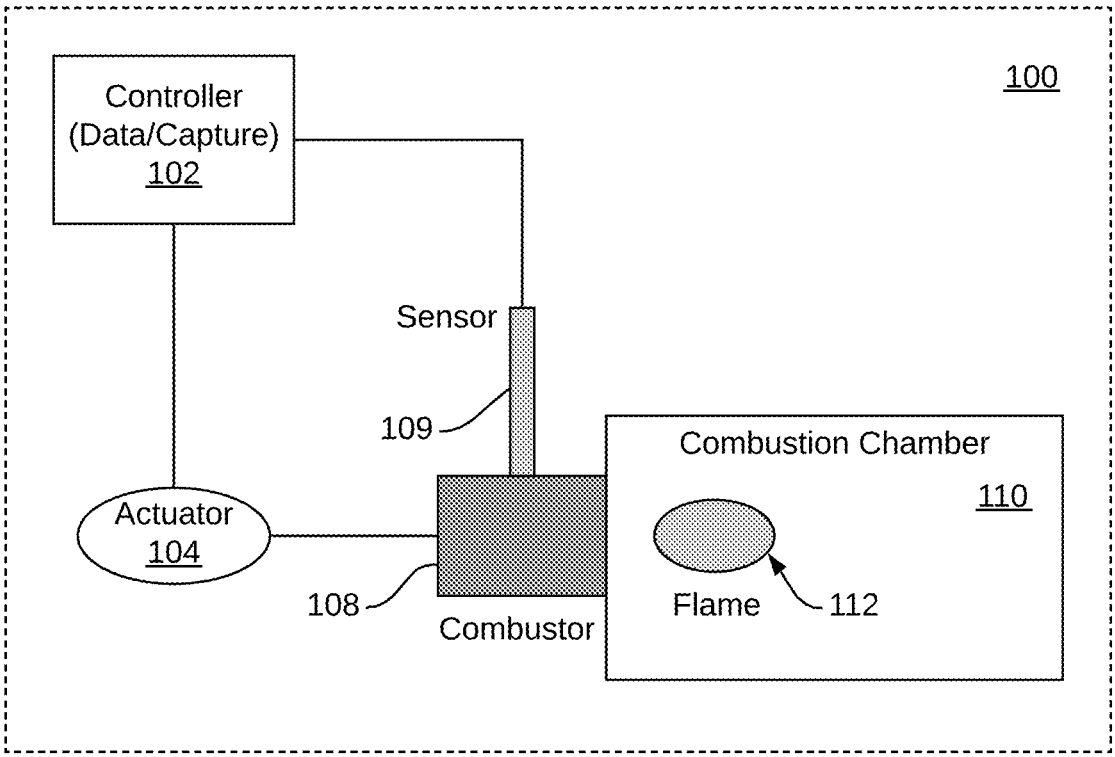
FIG. 1C illustrates a system for resonance suppression, in accordance with another embodiment.

FIG. 1A, FIG. 1B, and FIG. 1C illustrate a system 100 for resonance suppression, in accordance with one or more embodiments. Note that in FIG. 1A, FIG. 1B, and FIG. 1C similar or identical parts are generally indicated by identical reference numerals. The configurations shown in FIG. 1A, FIG. 1B, and FIG. 1C, however, depict different embodiments.

In the embodiment depicted in FIG. 1A, the system 100 can include a controller 102 that can communicate with an acoustic sensor 106 (or a group of sensors) that can be mounted to and/or in association with a combustor 108 (e.g., a burner). The controller 102 can also communicate with an actuator 104 (e.g. a burner actuator) which also can communicate with the combustor 108. The combustor 108 can be associated with a combustion chamber 110, which as depicted in FIG. 1A, includes a flame 112. The combustor 108 may be in some embodiments, a component of an industrial combustion system that includes the combustion chamber 110.

The system 100 can function as a resonance suppressor that uses a combustor damping rate. In the embodiment shown in FIG. 1A, the acoustic sensor 106 may be a microphone or another type of acoustic sensor. The acoustic sensor 106 can measure acoustic signals produced by the combustor 108. The acoustic sensor 106 can send these acoustic signals to the controller 102, which can then calculate the real-time damping rate of the combustor 108. Based on this calculation, the controller 102 can modulate the actuator 104 (e.g., a fuel valve or an air valve), if the damping rate falls below a predefined threshold until the damping rate (or damping rates) is adjusted and resonance is suppressed. The acoustic signals (or other types of signals) are produced by the combustor 108, which can be controlled by the actuator 104.

In some embodiments, the acoustic sensor 106 may be a microphone. In this situation, the microphone can function as an audible range sensor that measures sound waves over a broad spectral range. Different types of microphones may be used to implement the acoustic sensor 106 including but not limited to, for example, resistive microphones, condenser microphones, fiber-optic microphones, piezoelectric microphones, and so on.

In some embodiments, the acoustic sensor 106 may be, for example, a MEMS (Microelectromechanical Systems) device such as a surface acoustic wave sensor, which can rely on the modulation of surface acoustic waves to sense a physical phenomenon. The surface acoustic wave sensor transduces an input electrical signal into a mechanical wave, which, unlike an electrical signal, can be easily influenced by physical phenomena. The surface acoustic wave sensor then transduces this wave back into an electrical signal. Changes in amplitude, phase, frequency, or time-delay between the input and output electrical signals can be used to measure the presence of the desired phenomenon. In some embodiments the acoustic sensor 106 may be composed of multiple and different types of acoustic sensors, such as, for example, surface acoustic wave sensors and one or more microphones.

Note that the term "real-time" as utilized herein can refer to the condition in which if something is done in real time, there is no noticeable delay between the action and its effect or consequence. The term "real-time" as utilized herein can also refer to real-time computing, which can involve real-time processing, which is a type of computer programming or data processing in which the information received is processed by the computer almost immediately. Real-time can also refer to a level of computer responsiveness in which a user senses as sufficiently immediate or that enables the computer to keep up with some external process.

The system 100 can use measured combustor damping rates as a control signal for active instability suppression by modulating a fuel supply. The system 100 can further function as a control system that includes a microphone assembly including the acoustic sensor 106 that can be mounted in and/or in association with a burner body of the combustor 108. It will be evident to one skilled in the art that the damping rates may be calculated using multiple methods. Broadly speaking, these methods can involve fitting an assumed curve to either the spectra or the autocorrelation of the pressure signal. Once the damping rates fall below the predefined threshold (e.g., an alarm threshold), the actuator 104 can be modulated (i.e. fuel valve or air valve) until the damping rates increase, and resonance is suppressed.

Note that although the acoustic sensor 106 depicted in FIG. 1A is illustrated as being external to the combustion chamber 110, the acoustic sensor 106 may be located in some embodiments within the combustion chamber 110. Regardless of the location of the acoustic sensor 106, acoustic data (e.g., acoustic signals) can be captured by one or more of the acoustic sensors and processed by the controller 102 in real time. This data can be then uploaded to the "cloud" (if desired), or kept offline.

Note that the term "the cloud" as utilized herein can refer to servers that are accessible over a network such as the Internet, and the software and databases that can run on such servers. Cloud servers are located in data centers all over the world. By using cloud computing, users and companies may not have to manage physical servers themselves or run software applications on their own machines. The cloud also relates to cloud computing, which is the on-demand availability of computer system resources, especially data storage and computing power, without direct active management by the user. The term "the cloud" or "cloud computing" can be used to describe data centers available to many users over the Internet.

In the embodiment depicted in FIG. 1A, acoustic signals from the combustion chamber can be fed back into the data capture/controller device (i.e., the controller 102). The damping rates of the combustion chamber can be then calculated. If the damping rate is below a pre-defined threshold, the fuel valve can be modulated until the damping increases to an acceptable value. In this way, resonance can be prevented or suppressed.

In the alternative embodiment shown in FIG. 1B, an optical sensor 107 can be utilized in place of the acoustic sensor 106 of FIG. 1A. That is, the optical sensor 107 can measure a physical quantity of light and then translate it into a form that is readable by an instrument.

In the alternative embodiment depicted in FIG. 1C, another type of sensor 109 may be implemented instead of the acoustic sensor 106 shown in FIG. 1A and the optical sensor 108 depicted in FIG. 1B. That is, the sensor 109 shown in FIG. 1C represents a broad class of sensing devices, which may include acoustic sensors, optical sensors and/or other types of sensing devices and systems.

Figure 2:
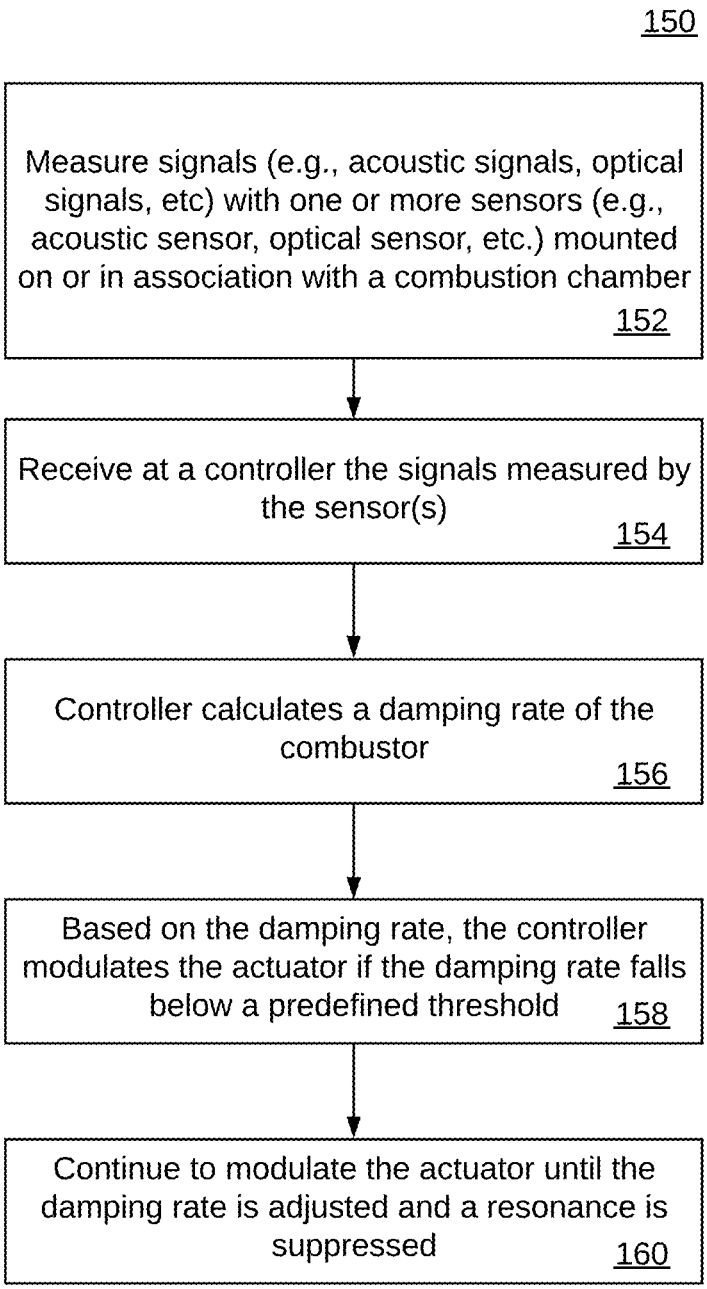
FIG. 2 illustrates a flow chart of operations depicting logical operations of a method for resonance suppression, in accordance with an embodiment.

FIG. 2 illustrates a flow chart of operations depicting logical operations of a method 150 for resonance suppression, in accordance with an embodiment. As shown at block 152, a step or operation can be implemented for measuring signals (e.g., acoustic signals, optical signals, etc.) with one or more sensors (e.g., an acoustic sensor such as a microphone, an optical sensor, etc.), wherein the signals are produced by a combustor associated with an actuator. Next, as depicted at block 154, a step or operation can be implemented in which the signals measured by the sensor(s) can be received at a controller. That is, measured acoustic signals, optical signals, and/or other types of measured signals can be received at the controller. Thereafter, as depicted at block 156, a step or operation can be implemented in which the controller can calculate the damping rate of the combustor based on the measured signal(s). Next, as shown at block 158, based on the damping rate(s), the controller can modulate the actuator if the damping rate falls below a predefined threshold. The controller can continue to module the actuator as shown thereafter at block 160 until the damping rate is adjusted and a resonance is suppressed.

It can be appreciated that steps or operations can be implemented, which can involve using different types of sensors, such as an acoustic sensor, an optical sensor or another type of sensor. The optical sensor 107 shown in FIG. 2B, for example, can be used for measuring optical signals, wherein optical signals are produced by the combustor 108 associated with the actuator 104. That is, a step or operation can be implemented in which the optical signals measured by the optical sensor 107 can be received at the controller 102. Then, a step or operation can be implemented in which the controller 102 can calculate the damping rate of the combustor 108. Then, based on the damping rate(s), the controller 102 can modulate the actuator 104 if the damping rate falls below a predefined threshold. The controller 102 can continue to modulate the actuator 104 as shown until the damping rate is adjusted and the resonance is suppressed.

In some embodiments, as discussed previously, an acoustic sensor such as a microphone can be utilized in place of the optical sensor 107 to measure acoustic signals produced by the combustor 108 associated with the actuator 104 and then the measured acoustic signals can be used to calculate the damping rate of the combustor, and so on. In some embodiments, both acoustic sensors and optical sensors can be used together in a configuration in which the acoustic sensor measures acoustic signals produced by the combustor 108 associated with the actuator 104, and the optical sensor measures optical signals produced by the combustor 108 associated with the actuator 104. These signals (acoustic signals and optical signals) can be used to calculate the damping rate of the combustor 108, and so on.

The disclosed embodiments thus relate to a specific physics-based metric for quantifying resonance, which can be particularly useful because the resonance quantification can be used for real-time control (e.g., such as modifying the fuel air ratio) to avoid resonance, or to alert the operator of an impending issue before resonance causes hardware damage. Both of these outcomes can save users time and money by reducing downtime or by reducing equipment damage. This approach can be integrated into a smart burner concept and the integration into the burner body (e.g. combustor 108) can be seamless to a user or customer. The disclosed approach thus can solve the problem of resonance in combustors (e.g., burners).

Figure 3:
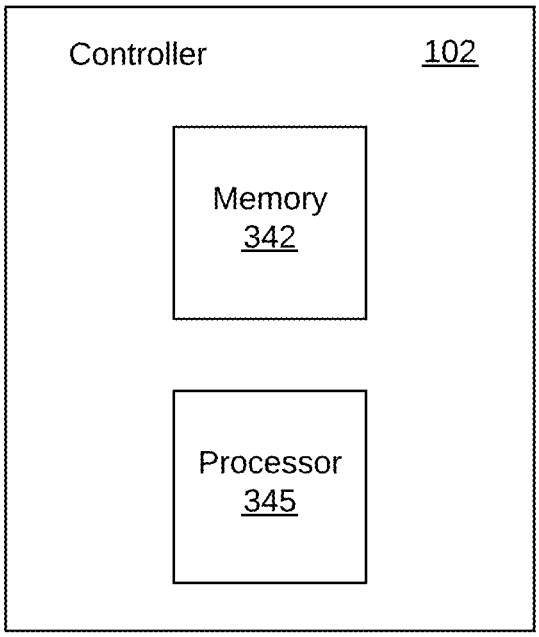
FIG. 3 illustrates a block diagram of a controller, which can be utilized for resonance suppression, in accordance with one or more embodiments.

FIG. 3 illustrates a block diagram of the controller 102, which can be utilized for resonance suppression, in accordance with one or more embodiments. The controller 102 can include a memory 342 and a processor 345 configured for resonance suppression, in accordance with the disclosed embodiments.

The memory 342 can be any type of storage medium that can be accessed by the processor 345 to perform one or more embodiments. For example, the memory 342 can be a non-transitory computer readable medium having computer readable instructions (e.g., computer program instructions) stored thereon that are executable by the processor 345 to measure acoustic signals with at least one microphone, wherein the acoustic signals are produced by a combustor associated with an actuator, and receiving at a controller the acoustic signals measured by the at least one microphone, wherein the controller calculates a damping rate of the combustor and wherein based on the damping rate, the controller modulates the actuator if the damping rate falls below a predefined threshold and continues to modulate the actuator until the damping rate is adjusted and a resonance is suppressed.

The memory 324 can be volatile or nonvolatile memory. The memory 324 can also be removable (e.g., portable) memory, or non-removable (e.g., internal) memory. For example, the memory 324 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Note that the term "controller" as utilized herein can refer to a device, component or module that can control the transfer of data from devices or components such as a computer, processor, memory and to on to a peripheral device and or/other components or devices, such as the acoustic sensor 106, the optical sensor 107, the actuator 104, the combustor 108 and so on. The controller 102 may be implemented as a computer chip or a data processing system such as the data processing system 400 discussed below.

As can be appreciated by one skilled in the art, embodiments can be implemented in the context of a method, a system, and data processing systems or computer program products. Accordingly, embodiments may take the form of an entirely hardware embodiment, an entirely software embodiment or an embodiment combining software and hardware aspects all generally referred to herein as a "circuit" or "module." Furthermore, embodiments may in some cases take the form of a computer program product on a computer-usable storage medium having computer-usable program code embodied in the medium. Any suitable computer readable medium may be utilized including hard disks, USB Flash Drives, DVDs, CD-ROMs, optical storage devices, magnetic storage devices, server storage, databases, etc.

Computer program code for carrying out operations of the present invention may be written in an object oriented programming language (e.g., Java, C++, etc.). The computer program code, however, for carrying out operations of particular embodiments may also be written in procedural programming languages, such as the "C" programming language or in a visually oriented programming environment, such as, for example, Visual Basic.

The program code may execute entirely on the user's computer, partly on the user's computer, as a stand-alone software package, partly on the user's computer and partly on a remote computer or entirely on the remote computer. In the latter scenario, the remote computer may be connected to a user's computer through a bidirectional data communications network such as a local area network (LAN) or a wide area network (WAN), a wireless local area network (WLAN), wireless data network e.g., Wi-Fi, Wimax, 802.xx, and/or a cellular network or the bidirectional connection may be made to an external computer via most third party supported networks (for example, through the Internet utilizing an Internet Service Provider).

The embodiments are described at least in part herein with reference to flowchart illustrations and/or block diagrams of methods, systems, and computer program products and data structures according to embodiments of the invention. It will be understood that each block or feature of the illustrations, and combinations of blocks or features, can be implemented by computer program instructions. These computer program instructions may be provided to a processor of, for example, a general-purpose computer, special-purpose computer, or other programmable data processing apparatus to produce a machine, such that the instructions, which execute via the processor of the computer or other programmable data processing apparatus, create means for implementing the functions/acts specified in the block or blocks or elsewhere herein. To be clear, the disclosed embodiments can be implemented in the context of, for example a special-purpose computer or a general-purpose computer, or other programmable data processing apparatus or system. For example, in some embodiments, a data processing apparatus or system can be implemented as a combination of a special-purpose computer and a general-purpose computer.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the various block or blocks, flowcharts, and other architecture illustrated and described herein.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 4:
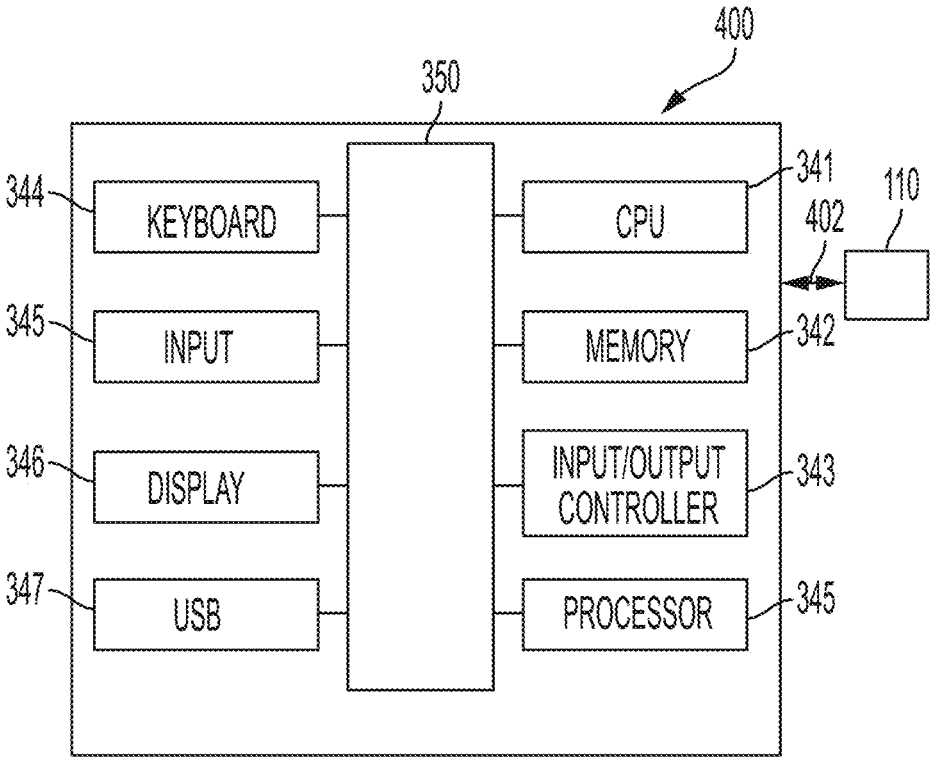
FIG. 4 illustrates a schematic view of a data-processing system, in accordance with an embodiment.
Figure 5:
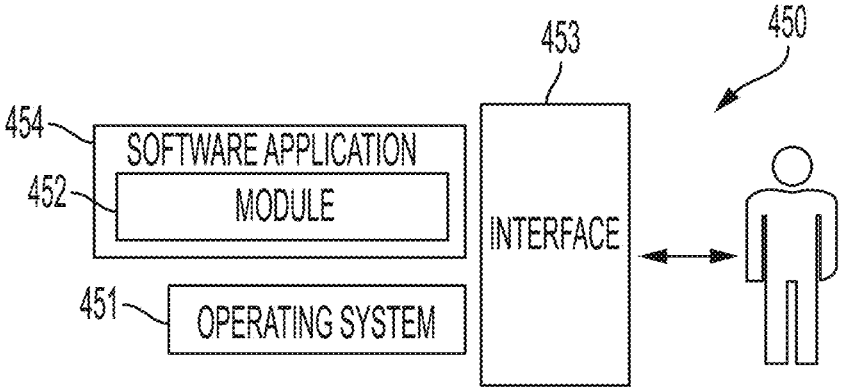
FIG. 5 illustrates a schematic view of a software system including a module, an operating system, and a user interface, in accordance with an embodiment.

FIG. 4 and FIG. 5 are shown only as exemplary diagrams of data-processing environments in which example embodiments may be implemented. It should be appreciated that FIG. 4 and FIG. 5 are only exemplary and are not intended to assert or imply any limitation with regard to the environments in which aspects or embodiments of the disclosed embodiments may be implemented. Many modifications to the depicted environments may be made without departing from the spirit and scope of the disclosed embodiments.

As illustrated in FIG. 4, some embodiments may be implemented in the context of a data-processing system 400 that can include, for example, one or more processors such as a CPU (Central Processing Unit) 341 and/or other another processor 349 (e.g., microprocessor, microcontroller etc), a memory 342, an input/output controller 343, a peripheral USB (Universal Serial Bus) connection 347, a keyboard 344 and/or another input device 345 (e.g., a pointing device, such as a mouse, track ball, pen device, etc.), a display 346 (e.g., a monitor, touch screen display, etc) and/or other peripheral connections and components. In an embodiment, the controller 102 discussed previously may be implemented as the data-processing system.

As illustrated, the various components of data-processing system 400 can communicate electronically through a system bus 351 or another similar architecture. The system bus 351 may be, for example, a subsystem that transfers data between, for example, computer components within data-processing system 400 or to and from other data-processing devices, components, computers, etc. The data-processing system 400 may be implemented in some embodiments as, for example, a server in a client-server based network (e.g., the Internet) or in the context of a client and a server (i.e., where aspects are practiced on the client and the server).

In some example embodiments, data-processing system 400 may be, for example, a standalone desktop computer, a laptop computer, a smartphone, a tablet computing device, a networked computer server, and so on, wherein each such device can be operably connected to and/or in communication with a client-server based network or other types of networks (e.g., wireless networks, cellular networks, Wi-Fi, etc). The data-processing system 400 can communicate with other devices such as, for example, an electronic device 110. Communication between the data-processing system 400 and the electronic device 110 can be bidirectional, as indicated by the double arrow 402. Such bidirectional communications may be facilitated by, for example, a computer network, including wireless bidirectional packet data communications networks.

FIG. 5 illustrates a computer software system 450 for directing the operation of the data-processing system 400 depicted in FIG. 4. Software application 454, stored for example in the memory 342 can include one or more modules such as module 452. The computer software system 450 also can include a kernel or operating system 451 and a shell or interface 453. One or more application programs, such as software application 454, may be "loaded" (i.e., transferred from, for example, mass storage or another memory location into the memory 342) for execution by the data-processing system 400.

The data-processing system 400 can receive user commands and data through the interface 453; these inputs may then be acted upon by the data-processing system 400 in accordance with instructions from operating system 451 and/or software application 454. The interface 453 in some embodiments can serve to display results, whereupon a user 459 may supply additional inputs or terminate a session. The software application 454 can include module(s) 452, which can, for example, implement instructions, steps or operations such as those discussed herein. Module 452 may also be composed of a group of modules and/or sub-modules.

The following discussion is intended to provide a brief, general description of suitable computing environments in which the system and method may be implemented. The disclosed embodiments can be described in the general context of computer-executable instructions, such as program modules, being executed by a single computer. In most instances, a "module" can constitute a software application, but can also be implemented as both software and hardware (i.e., a combination of software and hardware).

Generally, program modules include, but are not limited to, routines, subroutines, software applications, programs, objects, components, data structures, etc., that can perform particular tasks or which can implement particular data types and instructions. Moreover, those skilled in the art will appreciate that the disclosed method and system may be practiced with other computer system configurations, such as, for example, hand-held devices, multi-processor systems, data networks, microprocessor-based or programmable consumer electronics, networked PCs, minicomputers, mainframe computers, servers, and the like.

Note that the term module as utilized herein may refer to a collection of routines and data structures that perform a particular task or implements a particular data type. Modules may be composed of two parts: an interface, which lists the constants, data types, variable, and routines that can be accessed by other modules or routines, and an implementation, which may be private (e.g., accessible only to that module) and which can include source code that actually implements the routines in the module. The term module can also relate to an application, such as a computer program designed to assist in the performance of a specific task, such as implementing the steps, operations or instructions previously discussed herein with respect to, for example, block 152, block 154, block 156, block 158, and block 160 in FIG. 2, and elsewhere herein.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A method for resonance suppression, the method comprising:

measuring signals with at least one sensor, wherein the signals are produced by a combustor associated with an actuator including at least one of a burner actuator, a fuel valve or an air valve, wherein the at least one sensor mounted on the combustor;

receiving at a controller the signals measured by the at least one sensor in real-time, wherein the signals are processed and uploaded as a data package to a cloud device, by the controller in the real-time;

calculating a damping rate of the combustor from the measured signals received by the controller, in the real-time, wherein the step of calculating the damping rate further comprises fitting an assumed curve to at least one of spectra or autocorrelation of pressure signal of the combustor;

modulating a fuel supply associated with the actuator in the real-time, based on the damping rate when the damping rate falls below a predefined threshold and continue-modulating the fuel supply associated with the actuator until the damping rate is adjusted and the resonance is suppressed, wherein the damping rate is used as a control signal for active instability suppression of the resonance; and sending an alert to an operator based on the suppression of the resonance by modulating the fuel supply, wherein the alert is related to a physics-based metric for quantifying the resonance and wherein the alert relates to an impending issue before the resonance causes hardware damage.

2. The method of claim 1 wherein the at least one sensor comprises an acoustic sensor and the signals produced by the combustor comprise acoustic signals.

3. The method of claim 2 wherein the acoustic sensor comprises a microphone.

4. The method of claim 1 wherein the at least one sensor comprises an optical sensor.

5. The method of claim 1 wherein the combustor comprises a burner.

6. A system for resonance suppression, the method comprising:

at least one sensor operable to measure signals produced by a combustor associated with an actuator including at least one of a burner actuator, a fuel valve or an air valve, wherein the at least one sensor is mounted on the combustor; and a controller that configured to:

receive the signals measured by the at least one sensor in real-time, wherein the signals are processed and uploaded as a data pack;

calculate a damping rate of the combustor from the signals received by the controller, in the real-time, wherein the calculate of the damping rate further comprises fitting an assumed curve to at least one of spectra or autocorrelation of pressure signal of the combustor;

modulate a fuel supply associated with the actuator in the real-time, based on the damping rate when the damping rate falls below a predefined threshold and continue to modulate the fuel supply associated with the actuator until the damping rate is adjusted and the resonance is suppressed, wherein the damping rate is used as a control signal for active instability suppression of the resonance; and send an alert to an operator based on the suppression of the resonance by modulating the fuel supply, wherein the alert is related to a physics-based metric for quantifying the resonance and wherein the alert relates to an impending issue before the resonance causes hardware damage.

7. The system of claim 6 wherein the at least one sensor comprises an acoustic sensor and the signals produced by the combustor comprise acoustic signals.

8. The system of claim 7 wherein the acoustic sensor comprises a microphone.

9. The system of claim 6.

10. The system of claim 6 wherein the combustor comprises a burner.

11. A system for resonance suppression, the system comprising:

at least one processor; and a non-transitory computer-usable medium embodying computer program code, the computer-usable medium capable of communicating with the at least one processor, the computer program code comprising instructions executable by said at least one processor and configured for:

measuring signals with at least one sensor, wherein the signals are produced by a combustor associated with an actuator including at least one of a burner actuator, a valve, wherein the at least one sensor is mounted on the combustor; and receiving at a controller the signals measured by the at least one sensor in real-time, wherein the signals are processed and uploaded as a data package to a cloud device, by the controller in the real-time;

calculating a damping rate of the combustor from the signals received by the controller, in the real-time, wherein calculate of the damping rate comprises fitting an assumed curve to at least one of: a spectra or an autocorrelation of a pressure signal of the combustor;

modulating a fuel supply associated with the actuator in the real-time, based on the damping rate when the damping rate falls below a predefined threshold and continue modulating the fuel supply associated with the actuator until the damping rate is adjusted and the resonance is suppressed, wherein the damping rate is used as a control signal for active instability suppression of the resonance, wherein the suppression of the resonance by modulating the fuel supply is related to a physics-based metric for quantifying the resonance used to alert an operator of an impending issue before the resonance causes hardware damage.

12. The system of claim 11 wherein:

the at least one sensor comprises at least one of: an acoustic sensor and an optical sensor; and the combustor comprises a burner.

13. The system of claim 11 wherein the at least one sensor comprises an acoustic sensor, wherein acoustic signals from the combustion chamber are fed into the controller.

14. The system of claim 13 wherein the controller comprises a data capture/controller device.

15. The system of claim 14 wherein the data capture/controller device communicates with the burner actuator and the acoustic sensor.

16. The system of claim 11 wherein the at least one sensor comprises an optical sensor that measures a physical quantity of light and translates the physical quantity of light into a form that is readable by an instrument.

17. The system of claim 11 wherein the valve comprises a fuel valve.

18. The system of claim 11 wherein the valve comprises an air valve.

* * * * *